US006438952B1

(12) United States Patent
Nozawa et al.

(10) Patent No.: US 6,438,952 B1
(45) Date of Patent: Aug. 27, 2002

(54) HYDRAULIC CIRCUIT DEVICE

(75) Inventors: Yusaku Nozawa; Mitsuhisa Tougasaki, both of Ibaraki-ken; Yoshizumi Nishimura; Kinya Takahashi, both of Tsuchiura, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/673,938

(22) PCT Filed: Mar. 3, 2000

(86) PCT No.: PCT/JP00/01281

§ 371 (c)(1),
(2), (4) Date: Oct. 24, 2000

(87) PCT Pub. No.: WO00/52340

PCT Pub. Date: Sep. 8, 2000

(30) Foreign Application Priority Data

Mar. 4, 1999 (JP) ..... 11-057026

(51) Int. Cl.[7] ..... F15B 11/05; E02F 9/22
(52) U.S. Cl. ..... 60/422; 60/452; 91/447
(58) Field of Search ..... 60/422, 468, 452; 91/446, 447

(56) References Cited

U.S. PATENT DOCUMENTS 5,186,000 A * 2/1993 Hirata et al. ..... 91/447
5,937,645 A 8/1999 Hamamoto ..... 60/422

FOREIGN PATENT DOCUMENTS

| | | |
|---|---|---|
| DE | 19700276 | 7/1997 |
| JP | 2-296002 | 6/1990 |
| JP | 4-191501 | 7/1992 |
| JP | 5-263804 | 10/1993 |
| JP | 6-59604 | 8/1994 |
| JP | 2786941 | 5/1998 |
| JP | 10-89304 | 7/1998 |
| WO | WO9010795 | 9/1990 |
| WO | WO9831940 | 7/1998 |

* cited by examiner

*Primary Examiner*—F. Daniel Lopez
*Assistant Examiner*—Thomas E. Lazo
(74) *Attorney, Agent, or Firm*—Mattingly, Stanger & Malur, P.C.

(57) ABSTRACT

A hydraulic circuit system having a load sensing system including a hydraulic pump, a plurality of hydraulic actuators driven by a hydraulic fluid delivered from the hydraulic pump, a plurality of control valves disposed between the hydraulic pump and the plurality of acutators, a signal detecting hydraulic line to which a signal pressure based on a maximum load pressure among the plurality of hydraulic actuators is introduced, and pump control means for controlling a delivery pressure of the hydraulic pump to be held higher than the signal pressure by a predetermined value.

6 Claims, 11 Drawing Sheets

HYDRAULIC CIRCUIT DEVICE

TECHNICAL FIELD

The present invention relates to a hydraulic circuit system which is mounted on a construction machine including a plurality of hydraulic actuators often simultaneously operated, such as a hydraulic excavator, and which can provide a smooth start-up characteristic regardless of the magnitude of an inertia body to be driven.

BACKGROUND ART

There are two types of hydraulic circuit systems mounted on a construction machine such as a hydraulic excavator; one employing a center bypass control valve and including a bleed-off circuit, and the other employing a closed center control valve and including no bleed-off circuit. The latter hydraulic circuit system employs a load sensing system for controlling a delivery rate of a hydraulic pump so that a hydraulic fluid can be basically supplied at a flow rate demanded by the control valve. In the case of intending simplification of hydraulic equipment, the latter hydraulic circuit system is more advantageous because of including no bleed-off circuit. The absence of a bleed-off circuit however gives rise to the problem that, when a hydraulic actuator having large inertia is driven, the actuator is abruptly accelerated in a transient state due to a sudden rise of pressure, or the actuator is free from a smooth start-up characteristic because vibration of pressure (pressure pulsation) does not attenuate early.

More specifically, in the load sensing system, the delivery rate of the hydraulic pump is controlled so that the hydraulic fluid can be supplied at the flow rate demanded by the control valve. Accordingly, where a load to be driven by the actuator is an inertia body such as a swing body and the actuator cannot fully consume the hydraulic fluid delivered from the hydraulic pump, the delivery pressure of the hydraulic pump abruptly rises and the energy delivered from the hydraulic pump is accumulated in a piping system. Then, when the actuator has passed an acceleration range and pressure for acceleration is no longer required, the energy accumulated in the piping system is released upon lowering of the driving pressure, causing the actuator to overshoot. This overshoot further lowers the driving pressure. After that, the actuator speed is reduced, whereupon the driving pressure rises again, thus repeating changes in the actuator speed and the driving pressure. Stated otherwise, the actuator is brought into such a transient state that a sudden rise of pressure occurs and pressure pulsation does not attenuate early.

In view of the above problem, JP,A 4-191501, JP,A 5-263804, and JP,A 10-89304 propose methods for reducing a supply flow rate to the actuator with an increase of the driving pressure and suppressing a sudden rise of pressure.

The methods disclosed in JP,A 4-191501 and JP,A 5-263804 have the same purport and are intended to propose a control valve for controlling a displacement of a proportional seat valve having a slit in accordance with a valve opening of a pilot valve, wherein a displacement of the pilot valve is controlled depending on a driving pressure of an actuator to thereby control the displacement of the proportional seat valve. More specifically, a pressure having been introduced from an inlet portion of a hydraulic motor through a throttle is introduced to the pilot valve against the force acting upon the pilot valve for operation. The pressure having been introduced from the inlet portion of the hydraulic motor through the throttle is a pressure that increases in proportion to a driving pressure of the hydraulic motor. Therefore, the valve opening of the pilot valve is reduced in proportion to the driving pressure of the hydraulic motor, whereupon the valve opening of the proportional valve is also reduced. A hydraulic fluid delivered from a hydraulic pump is further controlled so as to reduce correspondingly. This reduction of the delivered hydraulic fluid contributes to moderating a sudden rise of pressure and attenuating pressure pulsation.

According to JP,A 10-89304, a pressure compensation valve provided for enabling the combined operation to be performed in the load sensing system is given with a load dependent characteristic that reduces a compensation differential pressure as a load pressure increases. This results in such control that as the load pressure increases, a supply flow rate to an actuator is reduced and a delivery rate of a hydraulic pump is also reduced. The load dependent characteristic of the pressure compensation valve is provided by setting, of pressure bearing areas of the pressure compensation valve, a pressure bearing area against which a pressure on the inlet side of a meter-in variable throttle acts in the closing direction, to be larger than a pressure bearing area against which a pressure on the outlet side of the meter-in variable throttle acts in the opening direction. By so setting a difference between both the pressure bearing areas, there occurs a hydraulic force that acts in the closing direction corresponding to the difference between both the pressure bearing areas, and is increased as the load pressure rises. In proportion to the load pressure, therefore, the differential pressure across the meter-in variable throttle is controlled so as to decrease and the supply flow rate to the actuator is reduced. With a reduction of the supply flow rate to the actuator, the delivery rate of the hydraulic pump under load sensing control is reduced. As a result, a sudden rise of pressure is avoided and pressure pulsation attenuates more early.

Meanwhile, JP,A 2-296002 proposes a hydraulic circuit system including a load sensing system, wherein a driving speed of a particular hydraulic actuator only is slowed down to achieve fine-speed operation without changing a target differential pressure of load sensing control set on pump control means. According to this proposal, a spring force of a check valve for detecting a load pressure is set to a certain degree of strength so that the load pressure is modulated with a pressure loss produced by the check valve. A detected signal pressure is lowered from the load pressure by an amount corresponding to the pressure loss, and a differential pressure between a delivery pressure of a hydraulic pump under the load sensing control and the load pressure is also lowered from an originally set value by an amount corresponding to the pressure loss. Consequently, the flow rate delivered under the load sensing control is reduced.

Further, PCT Laid-Open Publication WO98/31940 discloses a control valve for use in a hydraulic circuit system including a load sensing system, the control valve being constructed as a valve assembly in combination of a flow distribution valve and a hold check valve for simplification. In the disclosed control valve, a valve body of the flow distribution valve is partly incorporated in a hollow valve body of the hold check valve, a load pressure detecting hydraulic line of the control valve is formed as an internal passage (hydraulic line slit) of the flow distribution valve, and the internal passage is utilized to provide a check valve function. As a result, a check valve as a separate valve element is no longer required and the control valve is simplified in its overall construction.

DISCLOSURE OF THE INVENTION

With the proposals disclosed in JP,A 4-191501, JP,A 5-263804 and JP,A 10-89304, in proportion to the load pressure, the supply flow rate to the hydraulic actuator is reduced and the delivery rate of the hydraulic pump is also reduced. Upon driving of the hydraulic actuator, therefore, a sudden rise of pressure is avoided and pressure pulsation attenuates more early. A smooth start-up characteristic is thus obtained regardless of the magnitude of an inertia body to be driven. However, those prior-art techniques have the following problems.

The proposals disclosed in JP,A 4-191501 and JP,A 5-263804 are difficult to implement using an ordinary spool-type control valve from the structural point of view because the control valve employed in those proposals is constructed so as to control the valve opening of the proportional valve in accordance with the valve opening of the pilot valve. In a recent control valve, particularly, a spool inner space is utilized as a fluid passage for building a recovery circuit, and therefore a difficulty is doubled.

The proposal of JP,A 10-89304 discloses the valve structure of the pressure compensation valve adaptable for the case of using a spool-type control valve. Because the pressure compensation valve is constructed to have a certain difference between the pressure bearing areas, the structure is too complicated from the standpoint of assembly, and management of the pressure bearing areas is also troublesome.

The proposal of JP,A 2-296002 is intended to achieve fine-speed operation by slowing down the driving speed of the particular hydraulic actuator only. Despite such an intention, the delivery rate of the hydraulic pump is reduced, thus eventually resulting in that a sudden rise of pressure is avoided and pressure pulsation attenuates more early upon driving of the hydraulic actuator. Another advantage is that the structure is simplified because the pressure loss is just produced in the check valve for detecting the load pressure. However, the pressure loss produced in the check valve is set by the spring force and is a fixed value regardless of the load pressure. In other words, a control characteristic depending on the magnitude of an inertia body, i.e., a load dependent characteristic, is not obtained. This raises the problem that, depending on the magnitude of an inertia body to be driven, a sudden rise of pressure occurs and pressure pulsation does not attenuate early upon driving of the hydraulic actuator.

The control valve disclosed in PCT Laid-Open Publication WO98/31940 is constructed as a valve assembly in combination of a flow distribution valve and a hold check valve, and has various functions incorporated therein. The disclosed control valve is therefore advantageous in having a simplified overall construction. However, the disclosed control valve includes no measures against a sudden rise of pressure and pressure pulsation both occurred when an actuator having large inertia is driven. This raises the problem that, when a large inertia body is driven, a sudden rise of pressure occurs and pressure pulsation does not attenuate early upon driving of the hydraulic actuator.

An object of the present invention is to provide a hydraulic circuit system including a load sensing system, which can provide a smooth start-up characteristic regardless of the magnitude of an inertia body to be driven, and which has a simple construction and is easily adaptable even for a spool-type control valve.

(1) To achieve the above object, the present invention provides a hydraulic circuit system comprising a hydraulic pump, a plurality of hydraulic actuators driven by a hydraulic fluid delivered from the hydraulic pump, a plurality of control valves disposed between the hydraulic pump and the plurality of actuators, a signal detecting hydraulic line to which a signal pressure based on a maximum load pressure among the plurality of hydraulic actuators is introduced, and pump control means for controlling a delivery pressure of the hydraulic pump to be held higher than the signal pressure by a predetermined value, the plurality of control valves comprising respectively main valves including meter-in variable throttles for controlling flow rates of the hydraulic fluid supplied to the hydraulic actuators, and flow distribution valves disposed between the meter-in variable throttles and the actuators, each of the flow distribution valves including a valve body which has one end positioned in an inlet passage connected to the meter-in variable throttle and the other end positioned in a control chamber, the valve body being moved through a stroke depending on balance between a pressure in the control chamber and a pressure in the inlet passage to control the pressure in the inlet passage, thereby controlling a differential pressure across the meter-in variable throttle, wherein the hydraulic circuit system further comprises a first hydraulic line provided in each of the plurality of control valves for, when a load pressure of the associated hydraulic actuator is the maximum load pressure, detecting that load pressure and introducing the detected load pressure to the control chamber; a second hydraulic line provided in each of the plurality of control valves for connecting the control chamber to the signal detecting hydraulic line and introducing the signal pressure in the signal detecting hydraulic line to the control chamber when the load pressure of the associated hydraulic actuator is not the maximum load pressure; a third hydraulic line for connecting the signal detecting hydraulic line to a reservoir; a first throttle disposed in the third hydraulic line; and a second throttle disposed in the second hydraulic line of at least one of the plurality of control valves for, when the load pressure of the associated hydraulic actuator is the maximum load pressure, cooperating with the first throttle to modulate that load pressure and introducing the modulated load pressure, as the signal pressure, to the signal detecting hydraulic line.

Since the first hydraulic line and the second hydraulic line are provided in each of the plurality of control valves and the second throttle for cooperating with the first throttle to modulate the load pressure introduced to the control chamber and introducing the modulated load pressure to the signal detecting hydraulic line is disposed in the second hydraulic line of at least one control valve, the differential pressure across the second throttle is increased as the load pressure (maximum load pressure) of the hydraulic actuator associated with the at least one control valve rises, and the action of reducing the signal pressure introduced to the signal detecting hydraulic line is enhanced. Since the pump control means controls the delivery pressure of the hydraulic pump to be held higher than the signal pressure by the predetermined value, the differential pressure across the meter-in variable throttle of the relevant control valve is reduced as the load pressure rises, whereby the action of reducing a controlled flow rate is developed. At the start-up of the hydraulic actuator associated with the particular control valve, therefore, a supply flow rate to the associated hydraulic actuator is reduced depending on the load pressure, and a delivery rate of the hydraulic pump is also reduced. Accordingly, a sudden rise of pressure is avoided and hydraulic pressure pulsation attenuates more early upon driving of the hydraulic actuator. A smooth start-up characteristic is thus obtained regardless of the magnitude of an inertia body to be driven.

Further, since the second throttle is just additionally disposed in the second hydraulic line, the construction is very simple and easily adaptable even for a control valve having a main valve of the spool type. Also, there is no risk of a malfunction because the second throttle is just added.

(2) In above (1), preferably, the plurality of control valves further comprise respectively hold check valves disposed between the flow distribution valves and the hydraulic actuators whereby the first hydraulic lines detect, as the load pressures, pressures between the meter-in variable throttles and the hold check valves.

With those features, even when the load pressure of the hydraulic actuator becomes higher than the pressure at the meter-in throttle of the main valve, the load pressure is held by the hold check valve and the hydraulic fluid is prevented from flowing backward to the reservoir through the first hydraulic line, the second hydraulic line, the second throttle, the signal detecting hydraulic line, the third hydraulic line and the first throttle.

(3) In above (1) or (2), preferably, the flow distribution valve includes a hydraulic line slit formed in an outer periphery of the valve body thereof and opened to an outlet passage of the flow distribution valve, and a lap portion provided between the hydraulic line slit and the control chamber for making the hydraulic line slit open to the control chamber when the valve body of the flow distribution valve is moved through a stroke of predetermined distance in the valve opening direction, the hydraulic line slit and the lap portion jointly forming the first hydraulic line.

With those features, the first hydraulic line of the control valve is constituted as an internal passage (hydraulic line slit) of the flow distribution valve, and the check valve function is provided by utilizing the internal passage (hydraulic line slit). Therefore, the overall construction of the control valve is simplified.

(4) In above (1) or (2), preferably, the valve body of each flow distribution valve of the plurality of control valves has a pressure bearing area on the side of the inlet passage larger than a pressure bearing area on the side of the control chamber.

With that feature, characteristics of the control valve on the lower load pressure side is also improved in, for example, removing the influence of a flow force acting upon the flow distribution valve of the control valve on the lower load pressure side during the combined operation, and therefore better combined operation is achieved. Further, means, described in above (1), for improving characteristics of the control valve on the higher load pressure side and means (for changing the pressure bearing area) for improving the characteristics of the control valve on the lower load pressure side are independent of each other. Therefore, an improvement in characteristic of the control valve on the higher load pressure side and an improvement in characteristics of the control valve on the lower load pressure side can be achieved by mutually independent means, and flexibility in selection of equipment is increased to a large extent.

(5) In above (1) or (2), preferably, the second throttle is a variable throttle, and means for adjusting an opening area of the variable throttle is provided.

With those features, the opening area of the second throttle is freely adjustable and an optimum load dependent characteristic can be set depending on the type of actuator load.

(6) To achieve the above object, the present invention also provides a hydraulic circuit system comprising a hydraulic pump, a plurality of hydraulic actuators driven by a hydraulic fluid delivered from the hydraulic pump, a plurality of control valves disposed between the hydraulic pump and the plurality of actuators, a signal detecting hydraulic line to which a signal pressure based on a maximum load pressure among the plurality of hydraulic actuators is introduced, and pump control means for controlling a delivery pressure of the hydraulic pump to be held higher than the signal pressure by a predetermined value, the plurality of control valves comprising respectively main valves including meter-in variable throttles for controlling flow rates of the hydraulic fluid supplied to the hydraulic actuators, and pressure compensation valves disposed between the hydraulic pump and the meter-in variable throttles for controlling differential pressures across said meter-in variable throttles, wherein the hydraulic circuit system further comprises first hydraulic lines provided respectively in the plurality of control valves for introducing load pressures of the associated hydraulic actuators to pressure bearing sectors of the pressure compensation valves and controlling the differential pressures across the meter-in variable throttles; second hydraulic lines provided respectively in the plurality of control valves for detecting the load pressures of the associated hydraulic actuator; selecting means for detecting a maximum one of pressures in the second hydraulic lines of the plurality of control valves and introducing the detected maximum pressure, as the signal pressure, to the signal detecting hydraulic line; a third hydraulic line for connecting the signal detecting hydraulic line to a reservoir; a first throttle disposed in the third hydraulic line; and a second throttle disposed in the second hydraulic line of at least one of the plurality of control valves for, when the load pressure of the associated hydraulic actuator is the maximum load pressure, cooperating with the first throttle to modulate that load pressure and introducing the modulated load pressure, as the signal pressure, to the signal detecting hydraulic line.

With those features, the similar working advantages to those described in above (1) can be obtained in a hydraulic circuit system including a before-located-type flow distribution valve (pressure compensation valve).

BEST MODE FOR CARRYING OUT THE INVENTION

Embodiments of the present invention will be described below with reference to the drawings.

Initially, a hydraulic circuit system according to a first embodiment of the present invention will be described with reference to FIGS. 1 to 4A and 4B.

Figure 1:
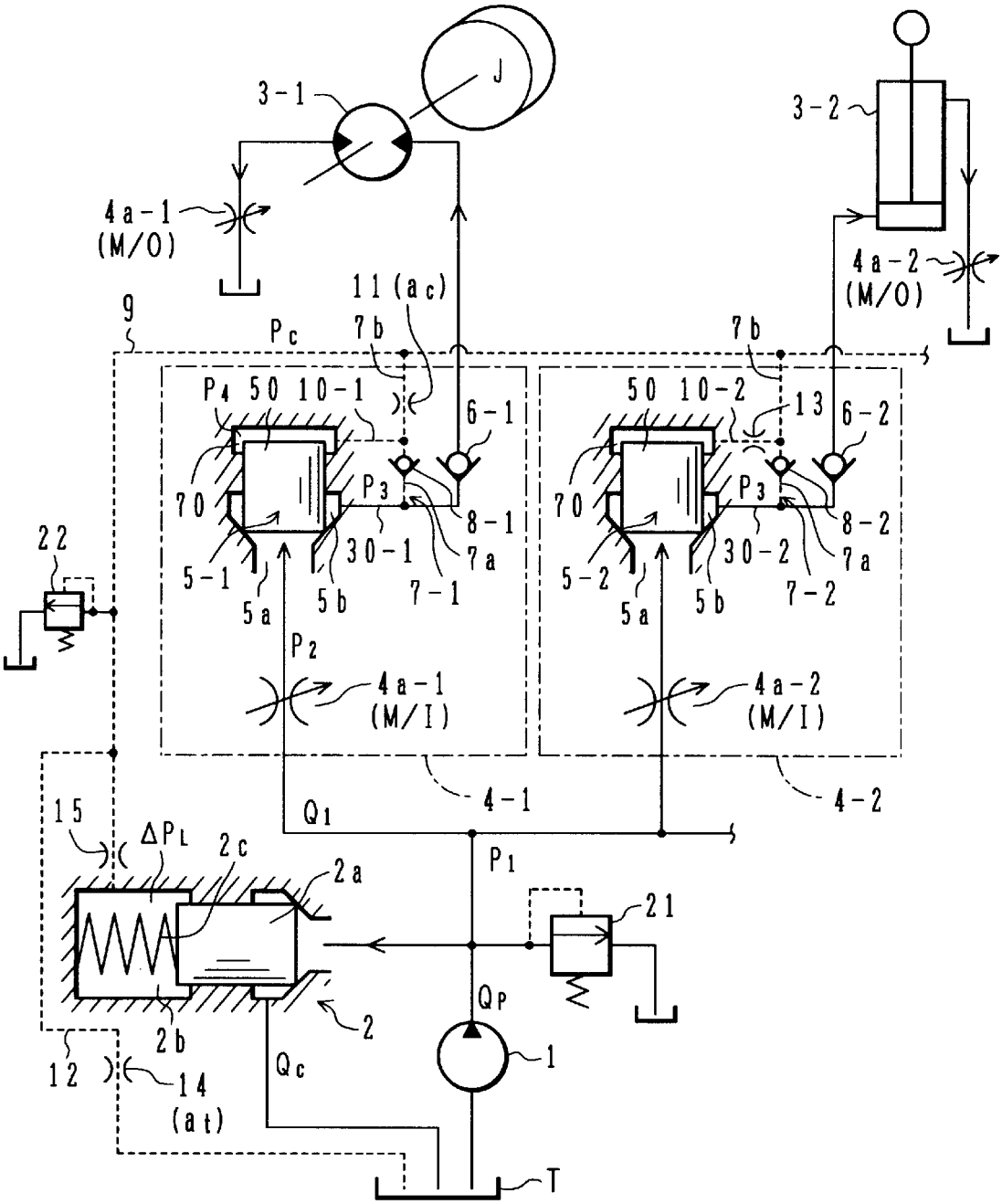
FIG. 1 is a diagram showing a hydraulic circuit system according to a first embodiment of the present invention.

Referring to FIG. 1, the hydraulic circuit system of this embodiment comprises a fixed displacement hydraulic pump 1, and a bleed valve 2 capable of bleeding all delivery rate of a hydraulic pump 1 with a small override. The combination of the hydraulic pump 1 and the bleed valve 2 constitutes a load sensing system employing a fixed pump.

Figure 2:
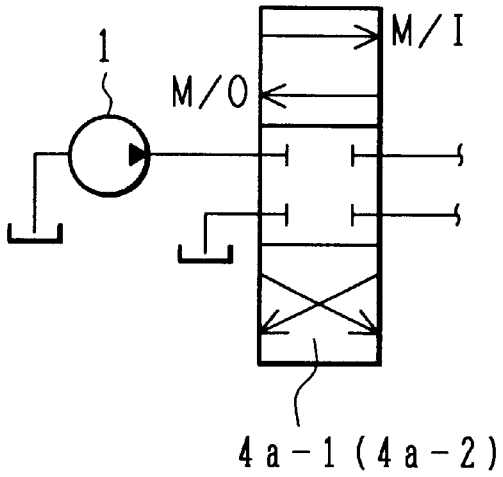
FIG. 2 shows a function of a main valve portion of a control valve using hydraulic symbols.

A hydraulic fluid delivered from the hydraulic pump 1 is supplied to a plurality of hydraulic actuators 3-1, 3-2. Between the hydraulic pump 1 and the hydraulic actuators 3-1, 3-2, control valves 4-1, 4-2 having spool-type main valves 4*a*-1, 4*a*-2 are disposed respectively, each main valve having a meter-in variable throttle M/I and a meter-out variable throttle M/O as shown in FIG. 2. By operating the main valves 4*a*-1, 4*a*-2 to shift in position, the directions of flow and the flow rates in and by which the hydraulic fluid is supplied to hydraulic actuators 3-1, 3-2 are controlled. The hydraulic actuator 3-1 is an actuator for driving a large inertia body, e.g., a swing motor for driving a swing body of a hydraulic excavator, and the hydraulic actuator 3-2 is an actuator that is very often operated simultaneously with the hydraulic actuator 3-1, e.g., a boom cylinder for driving a boom as one of links constituting a front operating mechanism of the hydraulic excavator when the hydraulic actuator 3-1 is the swing motor.

While only two actuators are shown in this embodiment, it is a matter of course that the number of actuators usable is not limited to two. For convenience of illustration, FIG. 1 shows the meter-in variable throttle M/I and the meter-out variable throttle M/O, which are only associated with one shift position of each of the main valves 4*a*-1, 4*a*-2, in a manner separated into the meter-in side and the meter-out side.

In addition to the main valves 4*a*-1, 4*a*-2 each having the meter-in variable throttle M/I and the meter-out variable throttle M/O, the control valves 4-1, 4-2 comprise respectively flow distribution valves 5-1, 5-2 for achieving the combined operation and hold check valves 6-1, 6-2, all these valves being incorporated therein.

In the control valve 4-1, the flow distribution valve 5-1 and the hold check valve 6-1 are disposed between the meter-in variable throttle M/I and the hydraulic actuator 3-1. The flow distribution valve 5-1 is disposed between the meter-in variable throttle M/I and the hold check valve 6-1.

Further, the flow distribution valve 5-1 has a valve body 50 that is moved through its stroke within a housing to change an opening area between an inlet passage 5*a* and an outlet passage 5*b*. A control chamber 70 is formed behind the valve body 50. The valve body 50 has a valve-opening-direction acting end positioned in the inlet passage 5*a* and a valve-closing-direction acting end positioned in the control chamber 70. The valve body 50 is moved through its stroke depending on balance between a pressure in the control chamber 70 and a pressure in the inlet passage 5*a* to make control such that the pressure in the inlet passage 5*a* is kept equal to the pressure in the control chamber 70. A differential pressure across the meter-in variable throttle M/I of the main valve 4*a*-1 is thereby controlled.

A load-pressure detecting hydraulic line 7-1 is branched from a hydraulic line 30-1 between the outlet passage 5*b* of the flow distribution valve 5-1 and the hold check valve 6-1, and is connected to a signal detecting hydraulic line 9. The signal detecting hydraulic line 9 is connected to a reservoir T through a hydraulic line 12 and a throttle 14 (having an area at) provided in the hydraulic line 12. Also, a control hydraulic line 10-1 is branched from the load-pressure detecting hydraulic line 7-1 and connected to the control chamber 70. A check valve 8-1 allowing the hydraulic fluid to flow only in a direction toward the signal detecting hydraulic line 9 from the hydraulic line 30-1 is provided in a hydraulic line portion 7*a* of the load-pressure detecting hydraulic line 7-1 between a branch point to the hydraulic line 30-1 and a branch point to the control hydraulic line 10-1. A throttle 11 (having an area ac>at), which is a feature of the present invention, is disposed in a hydraulic line portion 7*b* of the load-pressure detecting hydraulic line 7-1 between the branch point to the control hydraulic line 10-1 and the signal detecting hydraulic line 9.

In the above arrangement, the hydraulic line portion 7*a* and the check valve 8-1 constitute a hydraulic line with a check valve function, which, when the load pressure of the associated hydraulic actuator 3-1 is a maximum one, detects that load pressure from the hydraulic line between the flow distribution valve 5-1 and the hold check valve 6-1 and then introduces the detected load pressure to the control chamber 70. Also, the hydraulic line portion 7*b* connects the control chamber 70 to the signal detecting hydraulic line 9 and introduces a signal pressure in the signal detecting hydraulic line 9 to the control chamber 70 when the load pressure of the associated hydraulic actuator 3-1 is not a maximum one. Furthermore, when the load pressure of the associated hydraulic actuator 3-1 is a maximum one, the throttle 11 provided in the hydraulic line portion 7*b* cooperates with the throttle 14 (having an area at) provided in the signal detecting hydraulic line 9 to modulate the detected load pressure (as described later) and then introduce the modulated load pressure, as the signal pressure, to the signal detecting hydraulic line 9.

In the control valve 4-2, the throttle 11 is not provided in a hydraulic line portion 7*b* of a load-pressure detecting hydraulic line 7-2 between a branch point to a control hydraulic line 10-2 and the signal detecting hydraulic line 9, but a throttle 13 is provided instead in the control hydraulic line 10-2 for comparison with the arrangement of the control valve 4-2 to more clearly indicate the position of the throttle 11 in the load-pressure detecting hydraulic line 7-1. The throttle 11 of the control valve 4-1 cooperates with the throttle 14 provided in the signal detecting hydraulic line 9 to develop the function of modulating the load pressure detected in the signal detecting hydraulic line 9 as described above, while the throttle 13 of the control valve 4-2 has the function of moderating the operation of the flow distribution valve 5-2, but not the function of modulating the detected load pressure which is intended by the throttle 11. The other construction of the control valve 4-2 is the same as that of the control valve 4-1. In FIG. 1, identical components of the control valve 4-2 to those of the control valve 4-1 are denoted by the same main numerals with the sub-numeral "-2" in place of "-1", and a description thereof is omitted here.

The bleed valve 2 comprises a valve body 2*a*, a spring chamber 2*b* in which a valve-closing-direction acting end of the valve body 2*a* is positioned, and a spring 2*c* disposed in the spring chamber 2*b* for biasing the valve body 2*a* in the valve closing direction. The spring chamber 2*b* is connected to the signal detecting hydraulic line 9 through a throttle 15 for introducing the signal pressure detected in the signal detecting hydraulic line 9 to the spring chamber 2*b*. Assuming that the delivery pressure of the hydraulic pump 1 is P1 and the signal pressure in the signal detecting hydraulic line 9 is Pc, the bleed valve 2 functions such that, when a difference between P1 and Pc exceeds a differential pressure ΔPL set by the spring 2*c*, an extra flow from the hydraulic pump 1 is returned to the reservoir T. This implies that the extra flow is returned to the reservoir T when a differential pressure created depending on the flow rate of the hydraulic fluid passing each of the control valves 4-1, 4-2, i.e., a differential pressure between the inlet pressure (=P1) of the meter-in variable throttle M/I and the signal pressure Pc in the signal detecting hydraulic line 9, exceeds ΔPL.

Numeral 21 denotes a main relief valve for protecting the main circuit, and 22 denotes an auxiliary relief valve for protecting the signal circuit.

The operation of the hydraulic circuit system thus constructed will be described below. In the following description, it is assumed that the delivery pressure of the hydraulic pump 1 and the signal pressure in the signal detecting hydraulic line 9 are respectively P1, Pc as mentioned above, and that the pressure in the inlet passage 5*a* of the flow distribution valve 5-1 (referred to simply as the inlet pressure hereinafter) is P2, the pressure in the outlet passage 5*b* (referred to simply as the outlet pressure hereinafter) is P3, and the pressure in the control chamber 70 (referred to simply as the control pressure hereinafter) is P4. It is also assumed that a pressure loss in the hold check valve 6-1 is very small and the outlet pressure P3 of the flow distribution valve 5-1 is almost equal to the load pressure of the hydraulic actuator 3-1.

The detected-load-pressure modulating function of the throttle 11 will be first described.

Given the area of the throttle 11 being ac, the area of the throttle 14 being at, and the flow rate passing the throttles 11, 14 being q, the relationship between the control pressure P4 and the signal pressure Pc is expressed below on an assumption that ac>at holds and a pressure loss in the check valve 8-1 is negligible.

$$q=C\cdot ac\cdot\sqrt{(2g/Y)}\sqrt{(P4-Pc)}=C\cdot at\cdot\sqrt{(2g/Y)}\sqrt{Pc}$$

C: flow coefficient g: gravity

Y: viscosity coefficient

From the above relationship, the detected signal pressure Pc after having been modulated is given by:

$$Pc=\{ac^2/(ac^2+at^2)\}\cdot P4$$

Hence $$P4-Pc=\{at^2/ac^2+at^2\}\cdot P4 \quad (1)$$

The differential pressure of P4–Pc, i.e., the differential pressure across the throttle 11, is determined from the above relationship. The equation (1) shows that as the load pressure of the hydraulic actuator 3-1 (the outlet pressure P3) rises and the control pressure P4 increases, the differential pressure P4–Pc across the throttle 11 is increased and the action of the throttle 11 for reducing the signal pressure Pc is enhanced. In other words, the throttle 11 has the modulating function of, depending on the load pressure (the outlet pressure P3), increasing the differential pressure P4–Pc and hence reducing the signal pressure.

A description is now made of the operation of the control valve 4-1 during the sole operation of the hydraulic actuator 3-1 or during the combined operation performed when the load pressure of the hydraulic actuator 3-1 is a maximum one.

It is assumed that a differential pressure between the inlet pressure P2 of the flow distribution valve 5-1 and the control pressure P4 in the control chamber 70 is ΔPb1. This differential pressure ΔPb1 is given by a pressure loss occurred in a hydraulic line extending from the inlet passage 5*a* to the control chamber 70 and is a function of the flow rate passing the hydraulic line under control, the influence of the passing flow rate is here assumed to be minute as a result of the provision of a measure for minimizing the pressure loss. In this case, ΔPb1 is very small and the control pressure P4 is almost equal to the outlet pressure P3 of the flow distribution valve 5-1, i.e., to the load pressure.

Supposing that the throttle 11 is not provided, P4=Pc holds and the differential pressure across the meter-in variable throttle M/I of the main valve 4*a*-1 is expressed by:

$$P1-P2=(Pc+\Delta PL)-(P4+\Delta Pb1)=\Delta PL-\Delta Pb1 \quad (2)$$

On the other hand, where the throttle 11 is provided, the signal pressure Pc becomes lower than the control pressure P4 due to the detected-load-pressure modulating function of the throttle 11, and the differential pressure across the meter-in variable throttle M/I of the main valve 4*a*-1 is reduced by an amount corresponding to the differential pressure P4–Pc as expressed by the following equation:

$$P1-P2=(Pc+\Delta PL)-(P4+\Delta Pb1)=\Delta PL-\Delta Pb1-(P4-Pc) \quad (3)$$

Figure 3:
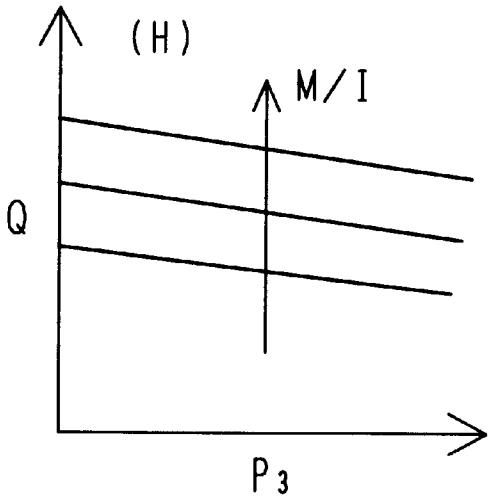
FIG. 3 is a graph showing a load dependent characteristic of the control valve on the higher load pressure side resulted from the provision of a throttle in the sole or combined operation.

Here, due to the modulating function of the throttle 11 expressed by the above equation (1), the differential pressure P4–Pc expressed by the equation (3) is increased as the load pressure (the outlet pressure P3) rises. Accordingly, as the load pressure rises, the action of reducing the flow rate passing under control is enhanced. Thus, with the provision of the throttle 11, the control valve 4-1 has such a load dependent characteristic that a controlled flow rate Q is reduced as the load pressure (the outlet pressure P3) rises, as shown in FIG. 3.

Figure 4B:
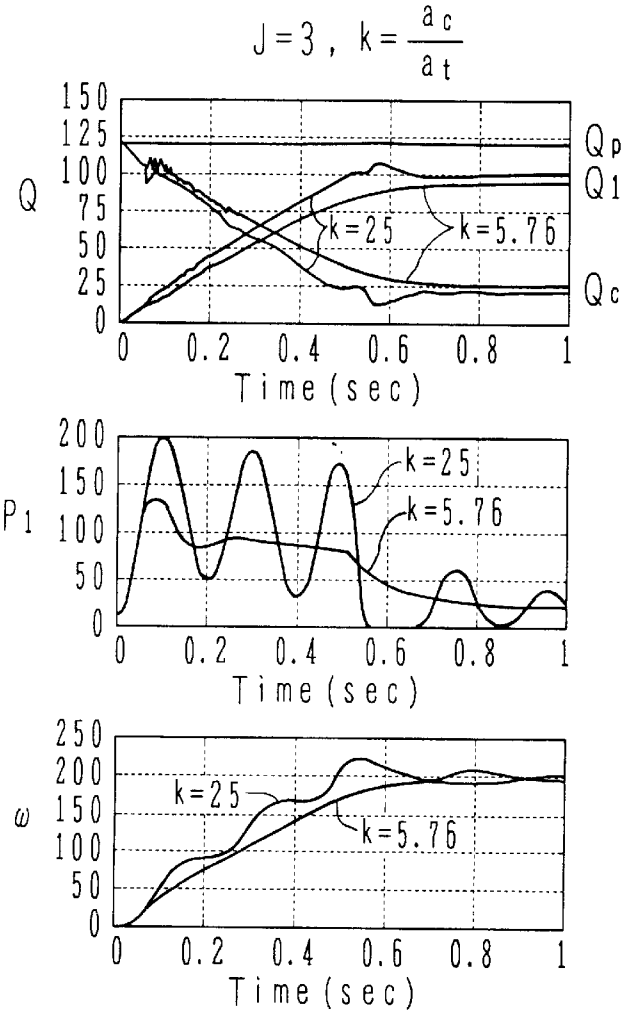
FIG. 4B shows results of simulation made for examining the effect obtained by the load dependent characteristic of the throttle when inertia moment is J=3 (three times that in FIG. 4A).
Figure 4A:
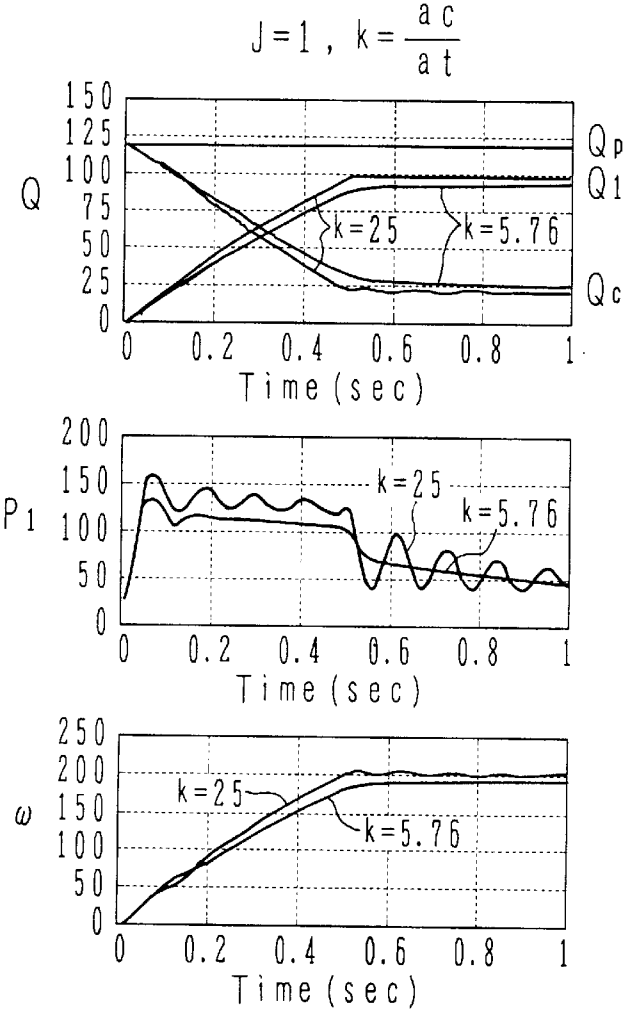
FIG. 4A shows results of simulation made for examining the effect obtained by the load dependent characteristic of the throttle when inertia moment is J=1.

FIGS. 4A and 4B show results of simulations made for examining the effect of the throttle 11. In FIGS. 4A and 4B, the simulations were made with different values of inertia moment of the hydraulic actuator 3-1; the inertia moment in FIG. 4B is three times that in FIG. 4A. An upper chart in each of FIGS. 4A and 4B represents the relationship among a delivery rate Qp of the hydraulic pump 1, a flow rate Q1 flowing to the load side, and a flow rate Qc bleeding to the bleed valve 2. The control valve 4-1 was operated through its full stroke in 0.5 second. A middle chart in each of FIGS. 4A and 4B represents the pump delivery pressure P1, and a lower chart represents an angular speed ω of the hydraulic actuator 3-1. For observing the effect of the throttle 11, a ratio k=ac/at of the opening area ac of the throttle 11 to the opening area at of the throttle 14 was selected as a parameter.

1) At k=25 where the throttle 11 produces no effect, hydraulic pressure pulsation is large and particularly notable when the inertia moment is large. Since this simulation was made on an assumption that the main relief valve 21 did not operate, the delivery pressure (driving pressure) P1 of the hydraulic pump 1 fairly rises with an increase of the inertia moment.

2) At k=5.76, the bleed flow rate passing the bleed valve 2 is transiently increased, the hydraulic actuator 3-1 is more smoothly rotated, and pressure pulsation is quickly attenuated. (In terms of throttle diameter, k=5.76 represents such a relationship that dc is about 1.2 as compared with dt=0.5). When the rotational speed reaches a fixed value, the driving pressure is lowered and the value of P4−Pc is also reduced, thus resulting in the same rotational speed as in the case of not modulating the detected pressure.

The operation of the control valve 4-2 on the lower load pressure side during the combined operation performed when the load pressure of the hydraulic actuator 3-1 is a maximum one, and the operation of the control valves 4-1, 4-2 during the combined operation performed when the load pressure of any other actuator than the hydraulic actuator 3-1 is a maximum one, are each similar to the operation of an ordinary control valve provided with a flow distribution valve. In the former case, the signal pressure Pc is transmitted to the control chamber 70 of the flow distribution valve 5-2. Then, assuming that a differential pressure between an inlet pressure of the flow distribution valve 5-2 and the control pressure in the control chamber 70 is ΔPb2, the flow distribution valve 5-2 controls a differential pressure across the meter-in variable throttle M/I of the main valve 4*a*-2 so as to become ΔPL−ΔPb2 in a like manner as expressed by the above equation (2). In the latter case, the signal detecting hydraulic line 9 detects, as the signal pressure Pc, the load pressure of the other actuator (the maximum load pressure), and the detected signal pressure Pc is transmitted to the control chambers 70 of the flow distribution valves 5-1, 5-2 of the control valves 4-1, 4-2. Then, the flow distribution valve 5-1 controls the differential pressure across the meter-in variable throttle M/I of the main valve 4*a*-1 as expressed by the above equation (2), and the flow distribution valve 5-2 controls the differential pressure across the meter-in variable throttle M/I of the main valve 4*a*-2 so as to become ΔPL−ΔPb2 in a like manner as expressed by the above equation (2).

With this embodiment, as described above, at the start-up of the hydraulic actuator 3-1 in the sole operation of the hydraulic actuator 3-1 or in the combined operation performed when the load pressure of the hydraulic actuator 3-1 is a maximum one, the supply flow rate to the hydraulic actuator 3-1 is reduced and the delivery rate of the hydraulic pump 1 is also reduced depending on the load pressure. Upon driving of the hydraulic actuator, therefore, a sudden rise of pressure is avoided and pressure pulsation attenuates more early. A smooth start-up characteristic is thus obtained regardless of the magnitude of an inertia body to be driven.

Also, the throttle 11 is disposed in the hydraulic line portion 7*b* of the load-pressure detecting hydraulic line 7-1 and cooperates with the throttle 14 disposed in the signal detecting hydraulic line 9 to increase the differential pressure across the meter-in variable throttle M/I depending on the load pressure. By utilizing such a phenomenon, the control valve 4-1 is given with a load dependent characteristic. Therefore, the above-described working advantage is obtained depending on the load pressure only regardless of the stroke position of the main valve 4*a*-1 (the opening of the meter-in variable throttle M/I), i.e., regardless of a shift position of a control lever (not shown) for producing a control signal to operate the main valve 4-1, and hence superior operability is ensured.

Further, since the throttle 11 is just additionally disposed in the load-pressure detecting hydraulic line 7-1, the construction is very simple and easily adaptable even for the case where the main valve 4*a*-1 of the control valve 4-1 is of the spool type. Also, there is no risk of a malfunction because the throttle 11 is just added.

Moreover, the hydraulic line portions 7*a* of the load-pressure detecting hydraulic lines 7-1, 7-2, in which the check valves 8-1, 8-2 are disposed, are branched from the hydraulic lines 30-1, 30-2 between the flow distribution valves 5-1, 5-2 and the hold check valves 6-1, 6-2, and the pressures in the hydraulic line portions 7*a* are detected as the load pressures. Therefore, even when the load pressures of the hydraulic actuators 3-1, 3-2 become higher than the pressures at the meter-in throttles M/I of the main valves 4*a*-1, 4*a*-2, the load pressures are held by the hold check valves 6-1, 6-2 and the hydraulic fluid is prevented from flowing backward to the reservoir through the load-pressure detecting hydraulic lines 7-1, 7-2, the signal detecting hydraulic line 9, the hydraulic line 12 and the throttle 14.

Figure 5:
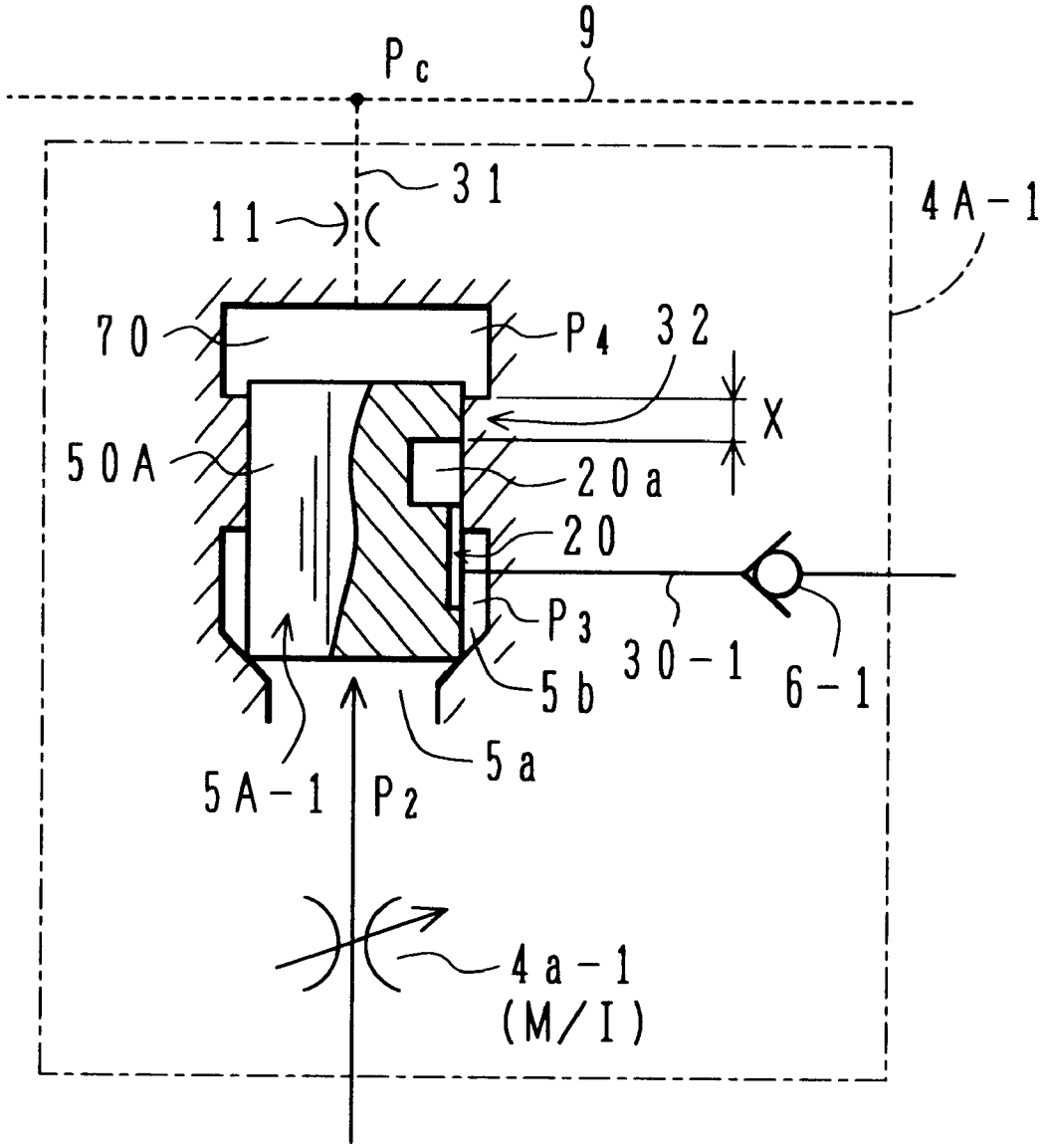
FIG. 5 is a diagram showing principal part of a hydraulic circuit system according to a second embodiment of the present invention.

A second embodiment of the present invention will be described with reference to FIG. 5. While the first embodiment shown in FIG. 1 is arranged such that the load-pressure detecting hydraulic line in the control valve is arranged outside the flow distribution valve, the load-pressure detecting hydraulic line is built in as an internal passage of the flow distribution valve in this embodiment. In FIG. 5, identical members to those shown in FIG. 1 are denoted by the same numerals.

Referring to FIG. 5, a flow distribution valve 5A-1 of a control valve 4A-1 associated with the hydraulic actuator 3-1 (see FIG. 1) has a valve body 50A that is moved through its stroke within a housing to change an opening area between an inlet passage 5*a* and an outlet passage 5*b*. A control chamber 70 is formed behind the valve body 50A. The valve body 50A has a valve-opening-direction acting end positioned in the inlet passage 5*a* and a valve-closing-direction acting end positioned in the control chamber 70. The valve body 50A is moved through its stroke depending on balance between a pressure in the control chamber 70 and a pressure in the inlet passage 5*a* to make control such that the pressure in the inlet passage 5*a* is kept equal to the pressure in the control chamber 70. A differential pressure across a meter-in variable throttle M/I of the control valve 4A-1 is thereby controlled. The above construction is the same as that of the flow distribution valve 5-1 of the control valve 4-1 described in the first embodiment.

In the control valve 4A-1 of this embodiment, a hydraulic line slit 20 is formed in an outer periphery of the valve body 50A and is opened to the outlet passage 5*b*. An end portion 20*a* of the hydraulic line slit 20 on the side nearer to the control chamber 70 is not opened to an end of the valve body 50A so that, when the valve body 50A is in the closed position as shown, a lap portion 32 having a lap amount X is formed between the hydraulic line slit 20 and the control chamber 70 to cut off communication therebetween. When the valve body 50A is moved through its stroke from the shown closed position in excess of the lap amount X, the hydraulic line slit 20 is opened to the control chamber 70. In other words, the lap portion 32 functions as a dead zone in the operation of the valve body 50A. The control chamber 70 is connected to the signal detecting hydraulic line 9 through a hydraulic line 31, and a throttle 11 is disposed in the hydraulic line 31.

In the above arrangement, the hydraulic line slit 20 and the lap portion 32 constitute a hydraulic line with a check valve function, which, when the load pressure of the associated hydraulic actuator 3-1 (see FIG. 1) is a maximum one, detects that load pressure from the hydraulic line between the flow distribution valve 5A-1 and the hold check valve 6-1 and then introduces the detected load pressure to the control chamber 70. In other words, the lap portion 32 effects a check valve function for allowing the load pressure to be detected only when the load pressure of the associated hydraulic actuator 3-1 (see FIG. 1) is a maximum one. Also, the hydraulic line 31 connects the control chamber 70 to the signal detecting hydraulic line 9 and introduces a signal pressure in the signal detecting hydraulic line 9 to the control chamber 70 when the load pressure of the associated hydraulic actuator 3-1 is not a maximum one. Further, when the load pressure of the associated hydraulic actuator 3-1 is a maximum one, the throttle 11 provided in the hydraulic line 31 cooperates with the throttle 14 to modulate the detected load pressure (the load pressure introduced to the control chamber 70) and then introduce the modulated load pressure, as the signal pressure, to the signal detecting hydraulic line 9.

A flow distribution valve on the side of the control valve 4-2 shown in FIG. 1 is constructed similarly to the above-described flow distribution valve 5A-1. However, the throttle 11 is not disposed in the hydraulic line 31.

With this embodiment, the load-pressure detecting hydraulic line of the control valve is constituted as an internal passage (hydraulic line slit 20) of the flow distribution valve in this embodiment, and the check valve function is provided by utilizing the internal passage (hydraulic line slit 20). Therefore, a dedicated hydraulic line and a dedicated check valve as a valve element are no longer required, and the overall construction of the control valve can be simplified.

Figure 6:
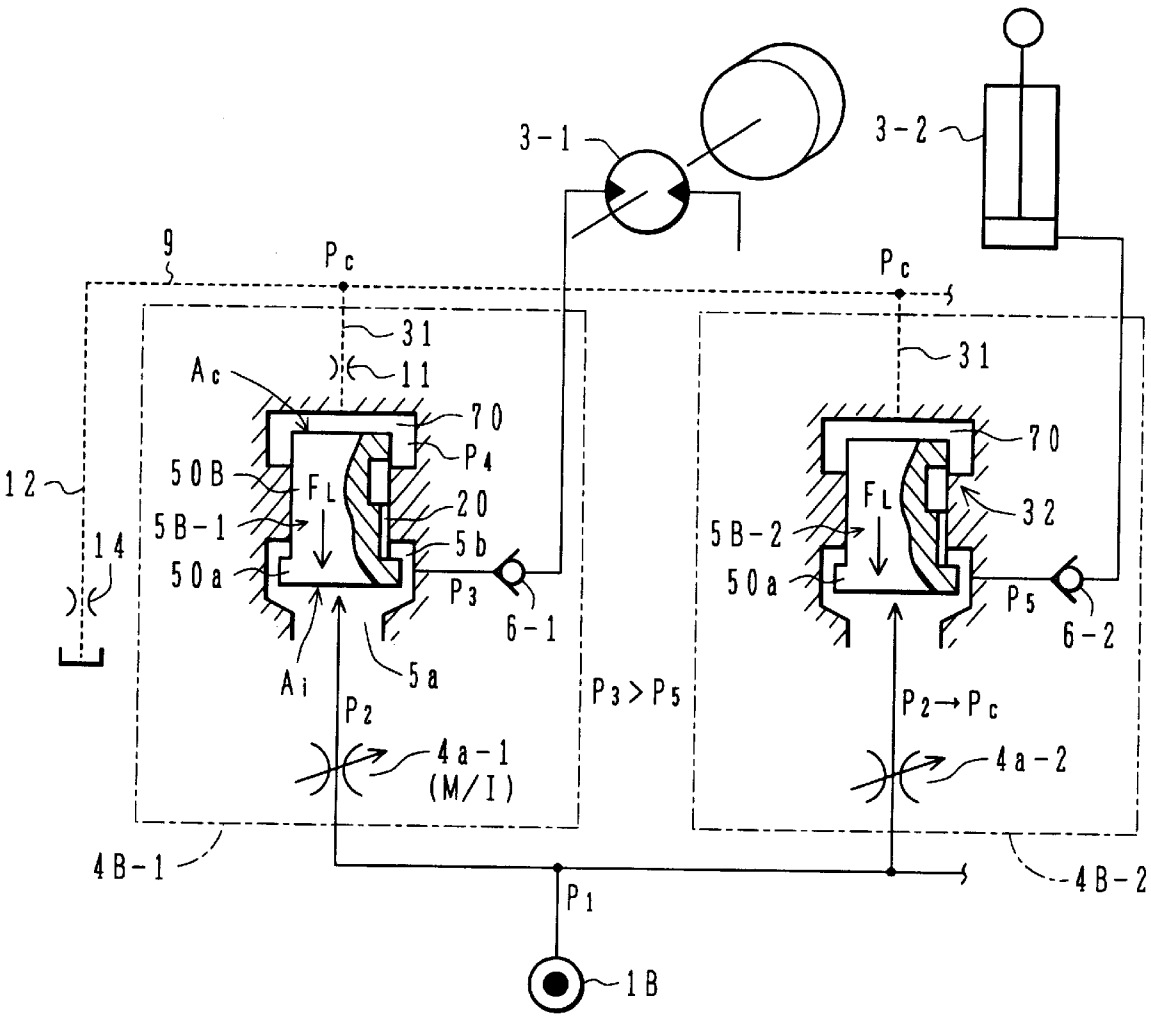
FIG. 6 is a diagram showing the hydraulic circuit system according to a third embodiment of the present invention.
Figure 7:
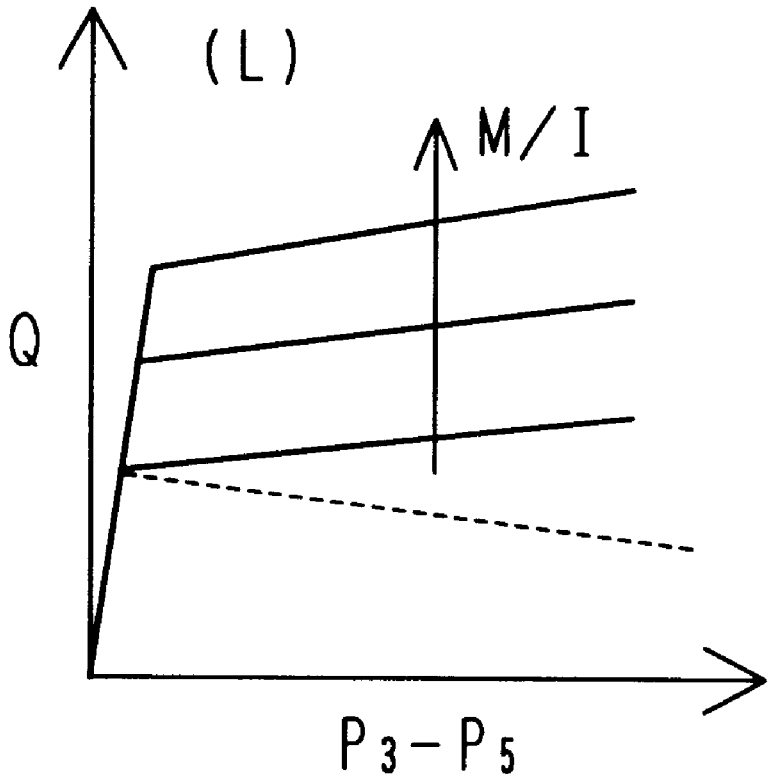
FIG. 7 is a graph showing a characteristic of a control valve on the lower load pressure side resulted in the combined operation.

A third embodiment of the present invention will be described with reference to FIGS. 6 and 7. This embodiment is intended to improve not only characteristics of the control valve on the higher load pressure side during the sole operation and the combined operation, but also characteristics of the control valve on the lower load pressure side during the combined operation. In FIG. 6, identical members to those shown in FIGS. 1 and 5 are denoted by the same numerals.

Referring to FIG. 6, control valves 4B-1, 4B-2 each have basically the same construction as the control valve in the embodiment of FIG. 5. More specifically, a hydraulic line slit 20 is formed in an outer periphery of a valve body 50B of each flow distribution valve 5B-1, 5B-2, and a check valve function is effected by a lap portion 32 between the hydraulic line slit 20 and the control chamber 70. A control chamber 70 and a signal detecting hydraulic line 9 are connected to each other through a hydraulic line 31, and a throttle 11 is disposed in the hydraulic line 31 on the side of the control valve 4B-1.

Further, in each of the control valves 4B-1, 4B-2 of this embodiment, a larger diameter portion 50*a* is formed at an end of the valve body 50B of the flow distribution valve 5B-1, 5B-2 on the side of an inlet passage 5*a* so that the end of the valve body 50B on the side of the inlet passage 5*a* has a larger diameter than an end of the valve body 50B on the side of the control chamber 70. Thus, a pressure bearing area Ai of the valve body 50B on the side of the inlet passage 5*a* and a pressure bearing area Ac thereof on the side of the control chamber 70 satisfies a relationship of Ai>Ac.

The other construction is the same as that in the embodiment shown in FIG. 1. Note that, in FIG. 6, the hydraulic pump 1, the bleed valve 2, and the relief valves 21, 22 shown in FIG. 2 are represented together by a hydraulic source 1B.

During the combined operation, there is a slight difference between flow rate characteristics demanded on the higher load pressure side and the lower load pressure side. As one of the characteristics demanded on the lower load pressure side during the combined operation, it is desired in some cases that the hydraulic fluid be supplied in a larger amount to the lower load pressure side. During the combined operation of a boom and swing in a hydraulic excavator, for example, the swing is desired to be driven by utilizing the driving pressure for extending the boom. Such a case requires a characteristic in which the function of a flow distribution valve is fairly moderated. A second point is removal of the influence of a flow force acting upon the flow distribution valve on the lower load pressure side. The flow force acting upon the flow distribution valve is given by:

$$FL=2\cdot C\cdot A(x)\cdot(\text{Pin}-\text{Pout})\cdot\cos\theta$$

C: flow coefficient

A(x): opening are determined by stroke x of valve body

Pin: inlet pressure

Pout: outlet pressure

θ: flow angle

The flow force FL is increased depending on a differential pressure Pin−Pout across a throttle of the flow distribution valve. The differential pressure Pin−Pout across the throttle of the flow distribution valve has a larger value in the flow distribution valve on the lower load pressure side. Therefore, the flow force acting upon the flow distribution valve causes a greater influence on the lower load pressure side.

As described above, since the throttle 11 is disposed in the control valve 4-1 on the higher load pressure side, the control valve 4-1 exhibits such a characteristic shown in FIG. 3 that the controlled flow rate Q is reduced as the load pressure (outlet pressure P3) increases. In the flow distribution valve 5-2 of the control valve 4-1 on the lower load pressure side, the signal pressure Pc in the signal detecting hydraulic line 9 is introduced to the control chamber 70. The valve body 50 of the flow distribution valve 5-1 on the higher load pressure side holds a balanced relation between the pressures P2 and P4, whereas the valve body 50 of the flow distribution valve 5-2 on the lower load pressure side holds a balanced relation with respect to the signal pressure Pc introduced to the control chamber 70. The signal pressure Pc is a value resulted from reducing the detected load pressure (outlet pressure P3) (=P4) through the throttle 11. Accordingly, the valve body 50 of the flow distribution valve 5-2 on the lower load pressure side should be balanced by the inlet pressure Pin lower than P2. However, the valve body 50 of the flow distribution valve 5-2 on the lower load pressure side is subjected to the flow force acting in the valve closing direction depending on the differential pressure Pin−P5 across the throttle of the valve body 50. To hold balance with respect to both the flow force and the signal pressure Pc in the control chamber 70, the inlet pressure Pin of the flow distribution valve 5-2 is required to be higher than P2. Stated otherwise, on the lower load pressure side, the differential pressure ΔPb2 between the inlet pressure Pin of the flow distribution valve 5-2 and the control pressure Pc in the control chamber 70, described above in the first embodiment by referring to the equation (2), is not negligible due to the influence of the flow force. This may cause a risk of producing such a characteristic that, as indicated by a dotted line in FIG. 7, the controlled flow rate Q is reduced as the differential pressure between P3 and P5 increases. In this event, the control valve 4-1 on the higher load pressure side controls the flow rate to be reduced as the load pressure rises, while the controlled flow rate is reduced in the control valve 4-2 on the lower load pressure side as the differential pressure between P3 and P5 increases. As a result, the intended function on the higher load pressure side is cancelled. Furthermore, the above phenomenon is contradictory to the principle because the hydraulic fluid consumed on the lower load pressure side is reduced when the pressure on the lower load pressure side is lowered with the pressure on the higher load pressure side kept constant.

In order to cancel the influence of the flow force in the flow distribution valve 5B-2 of the control valve 4B-2 on the lower load pressure side, this embodiment maintains the relationship of Ai>Ac between the pressure bearing area Ai on the side of the inlet passage 5*a* and the pressure bearing area Ac on the side of the control chamber 70, as described above, so that the differential pressure between the inlet pressure and the outlet pressure of the flow distribution valve 5B-2 acts upon the area of Ai−Ac. With this arrangement, the flow force is increased in proportion to the differential pressure of P3−P5 and acts upon the valve body 50B in the closing direction, while the force acting upon the area of Ai−Ac to urge the valve body 50B in the opening direction is also increased in proportion to the differential pressure of P3−P5. As a result, the influence of the flow force is canceled and a characteristic that the controlled flow rate Q is increased as the differential pressure of P3−P5 rises, as indicated by solid lines in FIG. 7, is obtained.

With this embodiment, better combined operation can be achieved by not only improving the characteristics of the control valve 4-1 by giving a load dependent characteristic to the characteristics of the control valve 4-1 on the higher load pressure side during the sole and combined operation, but also improving the characteristics of the control valve 4-2 on the lower load pressure side during the combined operation by removing the influence of the flow force. Further, means for improving the characteristics of the control valve 4-1 on the higher load pressure side is realized just by installing the throttle 11 in the signal detecting hydraulic line, and means for improving the characteristics of the control valve 4-2 on the lower load pressure side is realized just by modifying the pressure bearing area of the flow distribution valve 5-2. Both the improving means are completely independent of each other. Therefore, the performance demanded on the higher load pressure side and the performance demanded on the lower load pressure side can be achieved by mutually independent means, and flexibility in selection of equipment is increased to a large extent.

Figure 8:
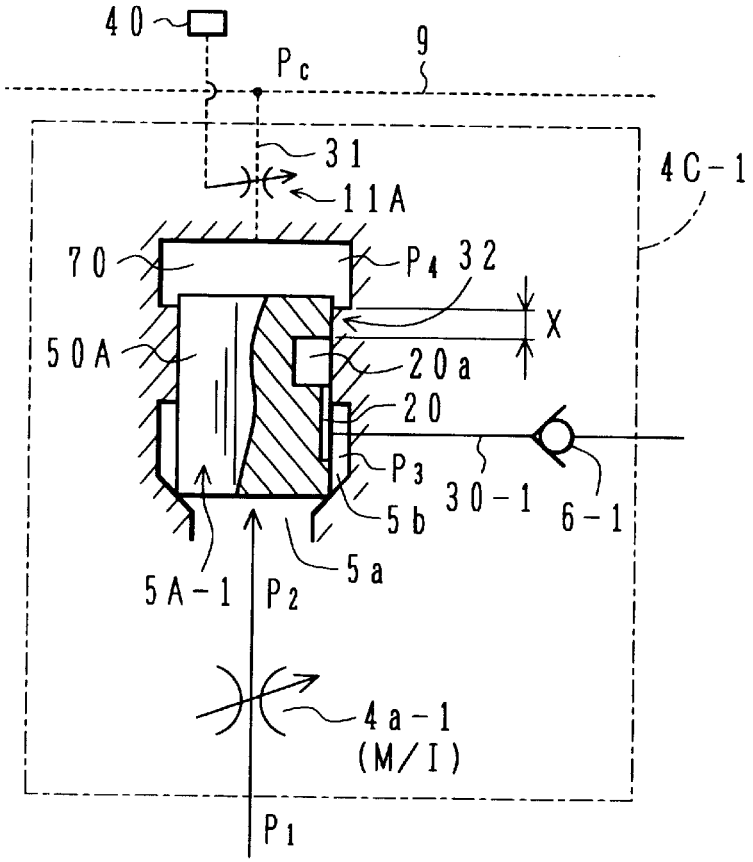
FIG. 8 is a diagram showing a hydraulic circuit system according to a fourth embodiment of the present invention.
Figure 9:
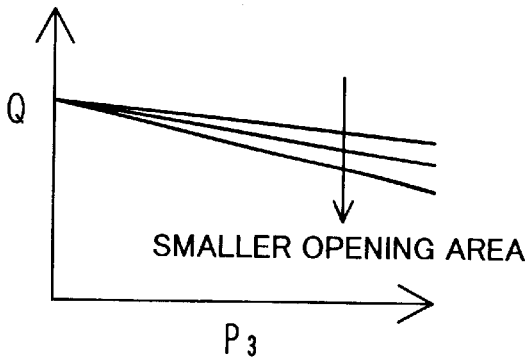
FIG. 9 is a graph showing change in load dependent characteristic of a control valve resulted when a throttle opening area is changed.

A fourth embodiment of the present invention will be described with reference to FIGS. 8 and 9. This embodiment employs a variable throttle as the throttle for giving a load dependent characteristic to the characteristics of the control valve on the higher load pressure side during the sole and combined operation. In FIG. 8, identical members to those shown in FIGS. 1 and 5 are denoted by the same numerals.

Referring to FIG. 8, a variable throttle 11A is disposed in a hydraulic line 31 of a control valve 4C-1 associated with the hydraulic actuator 3-1 (see FIG. 1). An opening area of the variable throttle 11A is adjustable, for example, by an operating member 40 provided externally. FIG. 9 shows change in load dependent characteristic resulted when the opening area of the variable throttle 11A is changed. As the throttle opening area reduces, a differential pressure across the throttle is increased, and hence the controlled flow rate is reduced at an increasing rate as the load pressure P3 rises.

By so adjusting the opening area of the variable throttle 11A externally, the load dependent characteristic of flow rate characteristics of the control valve 4C-1 is freely adjustable, and an optimum load dependent characteristic can be set depending on the type of actuator load.

Figure 10:
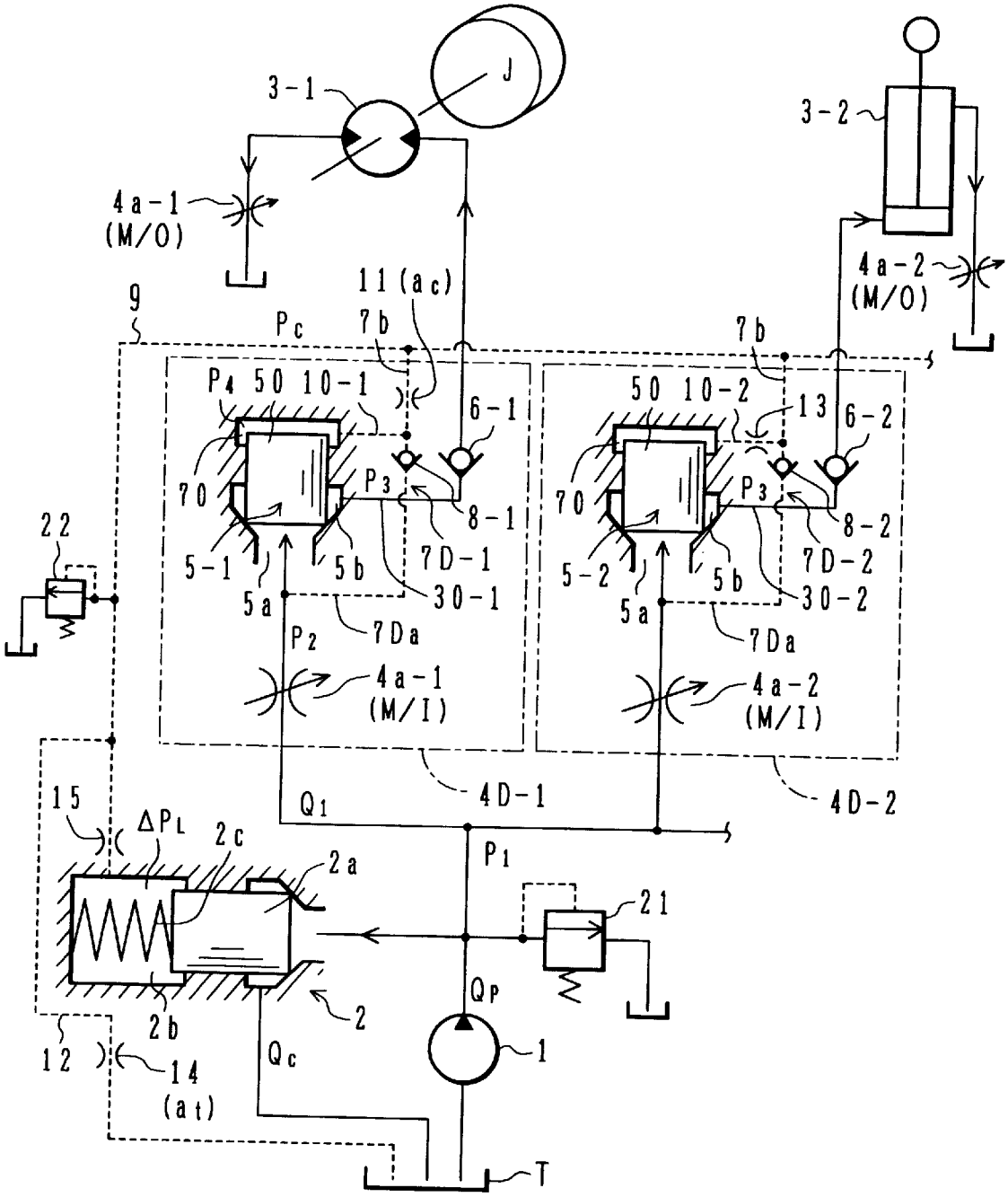
FIG. 10 is a diagram showing a hydraulic circuit system according to a fifth embodiment of the present invention.
Figure 11:
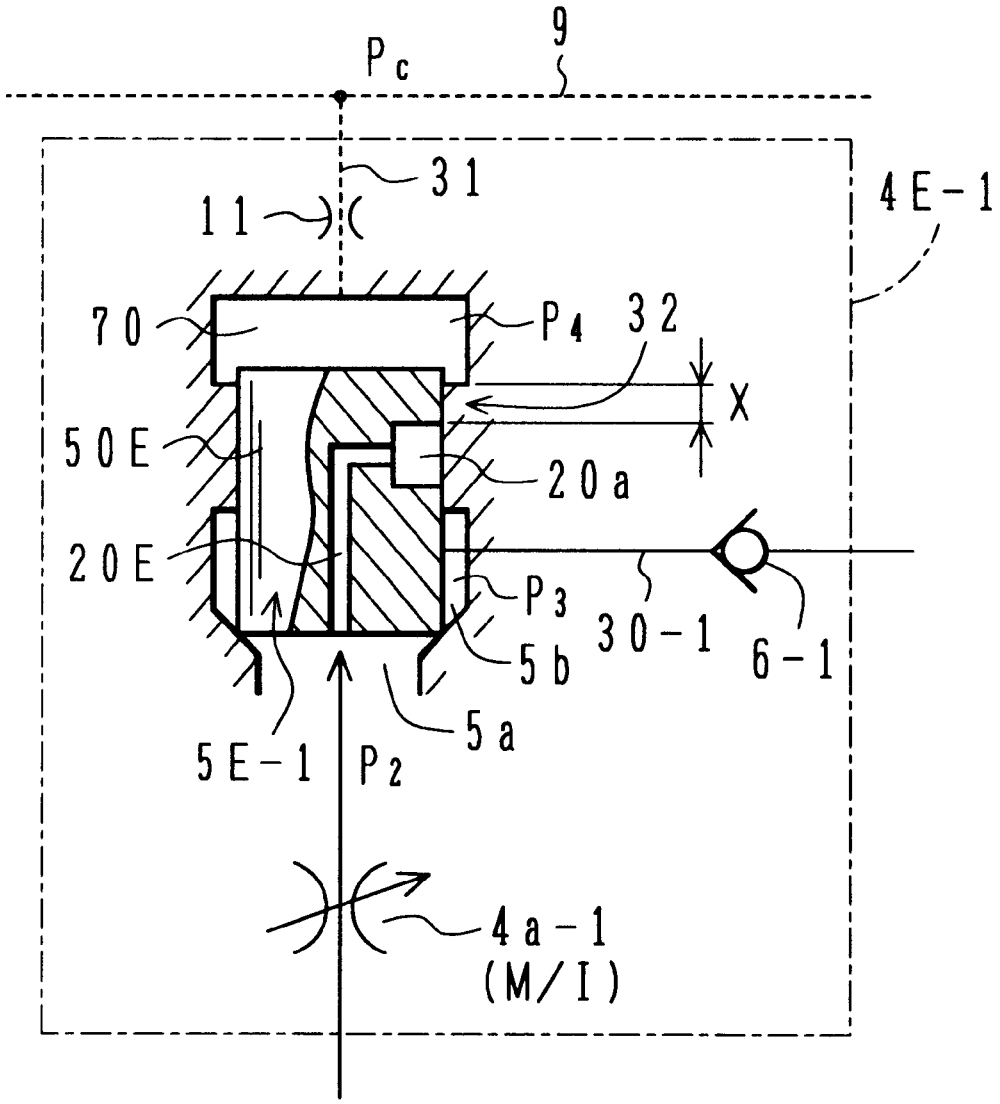
FIG. 11 is a diagram showing principal part of a hydraulic circuit system according to a sixth embodiment of the present invention.

Fifth and sixth embodiments of the present invention will be described with reference to FIGS. 10 and 11. In these embodiments, the load pressure is detected from different positions. In FIGS. 10 and 11, identical members to those shown in FIGS. 1 and 5 are denoted by the same numerals.

Referring to FIG. 10, a control valve 4D-1 according to the fifth embodiment of the present invention has a load-pressure detecting hydraulic line 7D-1. A hydraulic line portion 7Da of the load-pressure detecting hydraulic line 7D-1, in which a check valve 8-1 is disposed, is branched from a point between a meter-in variable throttle M/I of a main valve 4*a*-1 and an inlet passage 5*a* of a flow distribution valve 5-1. The load-pressure detecting hydraulic line 7D-1 detects the load pressure from a point between the main valve 4*a*-1 and the flow distribution valve 5-1 when the load pressure of the associated hydraulic actuator 3-1 is a maximum one, and then introduces the detected load pressure to a control chamber 70. A hydraulic line portion 7Da of a load-pressure detecting hydraulic line 7D-2 on the side of a control valve 4D-2, in which a check valve 8-2 is disposed, is likewise constructed.

FIG. 11 shows the sixth embodiment of the present invention wherein the load-pressure detecting hydraulic line in the fifth embodiment shown in FIG. 10 is built in as an internal passage of a flow distribution valve similarly to the second embodiment of FIG. 5 which is a modified version of the first embodiment of FIG. 1.

Referring to FIG. 11, an internal passage 20E being opened at one end to an inlet passage 5*a* is formed in a valve body 50E of a flow distribution valve 5E-1 provided in a control valve 4E-1. An opposite end portion 20*a* of the internal passage 20E is opened to an outer peripheral surface of the valve body 50E so that, when the valve body 50E is in the closed position as shown, a lap portion 32 having a lap amount X is formed between the open end portion 20*a* of the internal passage 20E and the control chamber 70 to cut off communication therebetween. When the valve body 50E is moved through its stroke from the shown closed position in excess of the lap amount X, the internal passage 20E is opened to the control chamber 70. In this case, the internal passage 20E and the lap portion 32 constitute a hydraulic line with a check valve function, which, when the load pressure of the associated hydraulic actuator 3-1 (see FIG. 1) is a maximum one, detects that load pressure from the hydraulic line between the flow distribution valve 5E-1 and the hold check valve 6-1 and then introduces the detected load pressure to the control chamber 70.

A flow distribution valve on the side of the control valve 4D-2 shown in FIG. 10 is constructed similarly to the above-described flow distribution valve 5E-1. However, a throttle 11 is not disposed in a hydraulic line 31.

When the load pressure of the associated hydraulic actuator is a maximum one during the sole or combined operation, the flow distribution valve 5-1, 5-2 is in the fully open state and the pressure in the inlet passage 5*a* of the flow distribution valve 5-1, 5-2 is almost equal to the pressure in the outlet passage 5*b* thereof. Accordingly, the fifth and sixth embodiments can also provide the similar advantages to those in the first and second embodiments, respectively.

Figure 12:
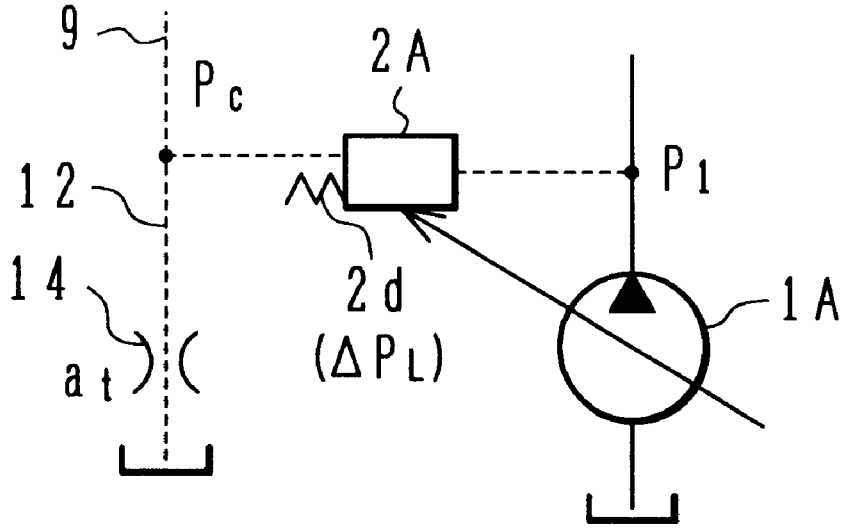
FIG. 12 is a diagram showing pump control means of a load sensing system when a variable displacement hydraulic pump is employed.

In any of the above embodiments, a fixed displacement hydraulic pump is used as the hydraulic pump and the bleed 2 is used as the pump control means for the load sensing system. As shown in FIG. 12, however, a variable displacement hydraulic pump 1A may be used as the hydraulic pump, and the pump control means for the load sensing system may be constituted by a tilting controller 2A for performing tilting control of the hydraulic pump 1A so that the delivery pressure Pi of the hydraulic pump 1A is held higher than the signal pressure Pc in the signal detecting hydraulic line 9 by a setting value ΔPL of a spring 2*d*. Using such a pump control means for the load sensing system can also provide the similar advantages.

Figure 13:
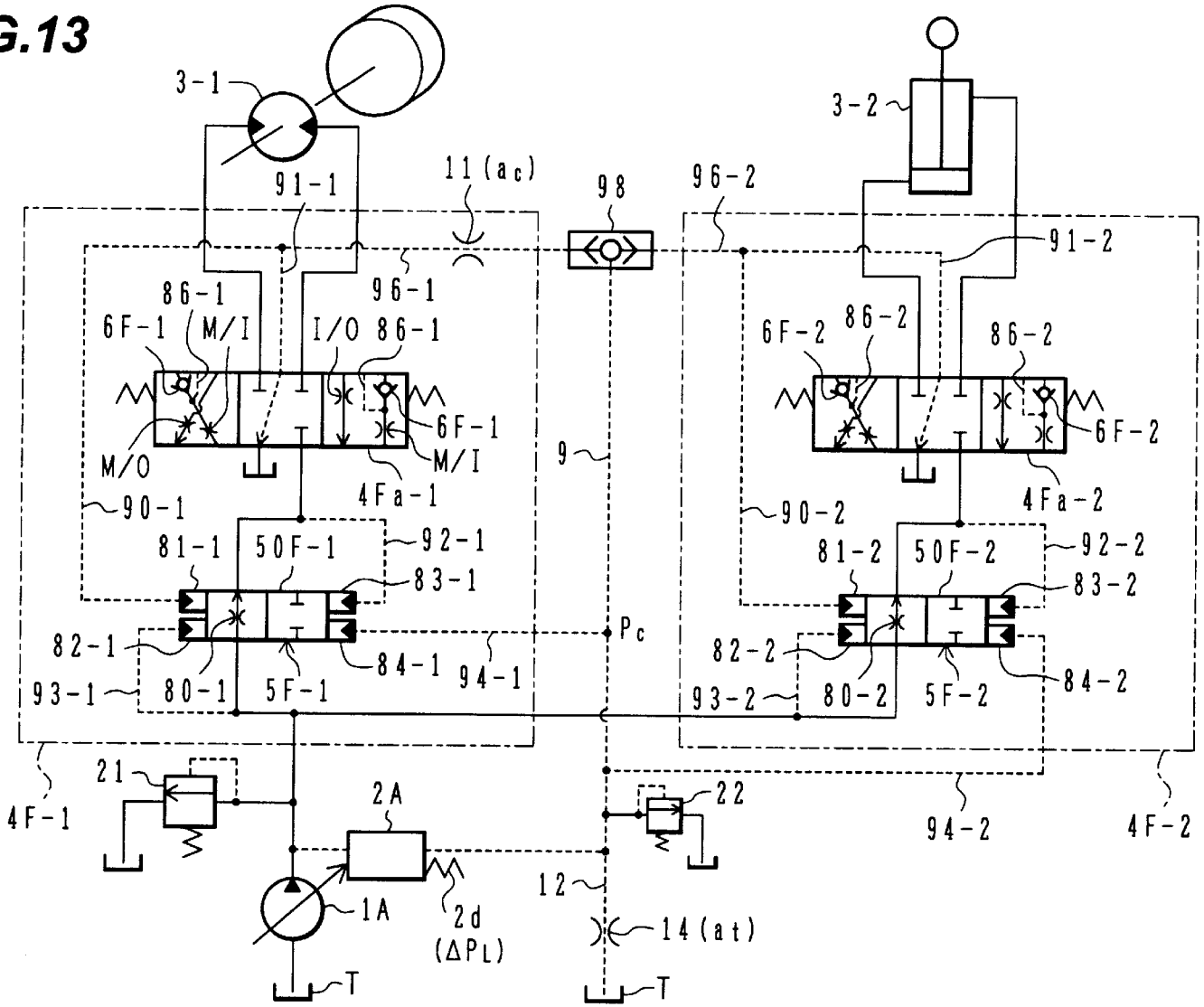
FIG. 13 is a diagram showing a hydraulic circuit system according to a seventh embodiment of the present invention.

A seventh embodiment of the present invention will be described with reference to FIG. 13. While an after-located-type flow distribution valve is used in any of the above embodiments as means for controlling the differential pressure across the meter-in variable throttle of the main valve, this embodiment uses a before-located-type flow distribution valve (pressure compensation valve). In FIG. 13, identical members to those shown in FIGS. 1 and 12 are denoted by the same numerals.

Referring to FIG. 13, control valves 4F-1, 4F-2 incorporate respectively main valves 4Fa-1, 4Fa-2 each having a meter-in variable throttle M/I and a meter-out variable throttle M/O, and flow distribution valves 5F-1, 5F-2 for achieving the combined operation. The main valves 4Fa-1, 4Fa-2 have hold check valves 6F-1, 6F-2 incorporated downstream of the respective meter-in variable throttles M/I.

In the control valves 4F-1, 4F-2, the flow distribution valves 5F-1, 5F-2 are before-located-type pressure compensation valves disposed between a hydraulic pump 1A and the meter-in variable throttles M/I of the main valves 4Fa-1, 4Fa-2.

The flow distribution valve 5F-1 comprises a spool 50F-1 serving as a valve body, a variable throttle portion 80-1 provided in the spool 50F-1, pressure bearing sectors 81-1, 82-1 for urging the spool 50F-1 in the opening direction of the variable throttle portion 80-1, and pressure bearing sectors 83-1, 84-1 for urging the spool 50F-1 in the closing direction of the variable throttle portion 80-1. The pressure bearing sectors 81-1, 83-1 serve to feedback control hydraulic pressures. Specifically, a load pressure of the hydraulic actuator 3-1 (outlet pressure at the meter-in variable throttle M/I of the main valve 4Fa-1) is introduced to the pressure bearing sector 81-1 through hydraulic lines 90-1, 91-1, and an inlet pressure at the meter-in variable throttle M/I of the main valve 4Fa- 1 is introduced to the pressure bearing sector 83-1 through a hydraulic line 92-1. The pressure bearing sectors 82-1, 84-1 serve to set a target compensation differential pressure. Specifically, a delivery pressure of the hydraulic pump 1A is introduced to the pressure bearing sector 82-1 through a hydraulic line 93-1, and a signal pressure Pc (described later) is introduced to the pressure bearing sector 84-1 through a hydraulic line 94-1.

The main valve 4Fa-1 has an internal hydraulic line 86-1 which is branched from a point between the meter-in variable throttle M/I and the hold check valve 6F-1 and detects a pressure at that point as the load pressure of the hydraulic actuator 3-1. The internal hydraulic line 86-1 is connected to the aforementioned hydraulic line 90-1 and another hydraulic line (load-pressure detecting hydraulic line) 96-1 so that the load pressure detected by the internal hydraulic line 86-1 is introduced to the hydraulic lines 90-1, 96-1. The hydraulic line 96-1 is connected to the input side of a shuttle valve 98.

The control valve 4F-2 also has a similar construction. In FIG. 13, identical components of the control valve 4F-2 to those of the control valve 4F-1 are denoted by the same main numerals with the sub-numeral "-2" in place of "-1", and a description thereof is omitted here.

The shuttle valve 98 detects a higher (maximum) one of the pressures in the hydraulic lines 96-1, 96-2 and then introduces the detected pressure, as the signal pressure Pc, to a signal detecting hydraulic line 9. The output side of the shuttle valve 98 is connected to the signal detecting hydraulic line 9, and the signal detecting hydraulic line 9 is connected to a reservoir T through a hydraulic line 12 and a throttle 14 (having an area at) disposed in the hydraulic line 12. Also, the aforementioned hydraulic lines 94-1, 94-2 are branched from the signal detecting hydraulic line 9, causing the signal pressure Pc in the signal detecting hydraulic line 9 to be introduced to the pressure bearing sectors 84-1, 84-2 of the flow distribution valves 5F-1, 5F-2 through the hydraulic lines 94-1, 94-2.

A throttle 11 (having an area ac>at), which is a feature of the present invention, is disposed in the hydraulic line 96-1 on the side of the control valve 4F-1. As with the first embodiment, when the load pressure of the associated hydraulic actuator 3-1 is a maximum one, the throttle 11 cooperates with the throttle 14 to modulate the maximum load pressure and then transmit the modulated load pressure, as the signal pressure Pc, to the shuttle valve 98 for introduction to the signal detecting hydraulic line 9.

In this embodiment thus constructed, as the load pressure of the hydraulic actuator 3-1 (the outlet pressure of the meter-in variable throttle M/I) rises, a differential pressure across the throttle 11 is increased and the action of the throttle 11 for reducing the signal pressure Pc is enhanced. In other words, the throttle 11 has the modulating function of, depending on the load pressure, increasing the differential pressure across the throttle 11 and hence reducing the signal pressure Pc. The control valve 4F-1 has such a load dependent characteristic that the controlled flow rate is reduced as the load pressure rises.

In a hydraulic circuit system including a before-located-type flow distribution valve (pressure compensation valve), therefore, this embodiment can also provide the similar advantages to those in the first embodiment.

While several embodiments of the present invention have been described above, those embodiments can be modified in various ways within the scope of the sprit of the present invention. In the above embodiments, for example, the throttle 11 is provided only in the control valve on the side of the hydraulic actuator 3-1 so that only the relevant control valve is given with a load dependent characteristic. Regardless of the load type of hydraulic actuator, the load driven by the hydraulic actuator is an inertia body although it varies in inertia. Therefore, the throttle 11 may be likewise disposed in a load detecting hydraulic line of one or more other control valves (the control valve 4-2 in the embodiment of FIG. 1) than that on the side of the hydraulic actuator 3-1, so that control valves of several or all of the hydraulic actuators have load dependent characteristics. In such a case, a throttle of each control valve is preferably constituted by a variable throttle having an externally adjustable opening area as with the embodiment shown in FIG. 8. By employing a variable throttle, an optimum load dependent characteristic can be set depending on the type of actuator load from the outside after assembly of the control valve.

INDUSTRIAL APPLICABILITY

According to the present invention, at the start-up of a hydraulic actuator, a supply flow rate to the hydraulic actuator is reduced depending on a load pressure and the delivery rate of the hydraulic pump is also reduced. Upon driving of the hydraulic actuator, therefore, a sudden rise of pressure is avoided and hydraulic pressure pulsation attenuates more early. A smooth start-up characteristic is thus obtained regardless of the magnitude of an inertia body to be driven.

Also, a second throttle is disposed in a second hydraulic line and cooperates with a first throttle disposed in a signal detecting line to modulate a load pressure, thereby increasing a differential pressure across a control valve. By utilizing such a phenomenon, the control valve is given with a load dependent characteristic. Therefore, the above-described advantage is obtained depending on the load pressure only regardless of the stroke position of a main valve, i.e., regardless of a shift position of a control lever for producing a control signal to operate the main valve, and hence superior operability is ensured.

Further, since the second throttle is just additionally disposed in a load-pressure detecting hydraulic line, the construction is very simple and easily adaptable even for a control valve having a main valve of the spool type. Also, there is no risk of a malfunction because the second throttle is just added.

Moreover, a first hydraulic line is branched from a hydraulic line portion between a flow distribution valve and a hold check valve, and a pressures in the hydraulic line portion is detected as the load pressure. Therefore, even when the load pressure of the hydraulic actuator becomes higher than the pressure at a meter-in throttle of the main valve, the load pressure is held by the hold check valve and a hydraulic fluid is prevented from flowing backward to a reservoir through the first hydraulic line, the second hydraulic line, the second throttle, the signal detecting hydraulic line, a third hydraulic line and the first throttle.

Furthermore, according to the present invention, the load-pressure detecting hydraulic line of the control valve is constituted as an internal passage of the flow distribution valve, and the check valve function is provided by utilizing the internal passage. Therefore, the overall construction of the control valve can be simplified.

Additionally, according to the present invention, characteristics of a control valve on the lower load pressure side is also improved in, for example, removing the influence of a flow force acting upon a flow distribution valve of the control valve on the lower load pressure side during the combined operation, and therefore better combined operation can be achieved. Further, an improvement in characteristic of the control valve on the higher load pressure side and an improvement in characteristics of the control valve on the lower load pressure side can be achieved by means independent of each other. Therefore, flexibility in selection of equipment is increased to a large extent.

What is claimed is:

1. A hydraulic circuit system comprising a hydraulic pump , a plurality of hydraulic actuators driven by a hydraulic fluid delivered from said hydraulic pump, a plurality of control valves disposed between said hydraulic pump and said plurality of actuators, a signal detecting hydraulic line to which a signal pressure based on a maximum load pressure among said plurality of hydraulic actuators is introduced, and pump control means for controlling a delivery pressure of said hydraulic pump to be held higher than said signal pressure by a predetermined value, said plurality of control valves comprising respectively main valves including meter-in variable throttles for controlling flow rates of the hydraulic fluid supplied to said hydraulic actuators , and flow distribution valves disposed between said meter-in variable throttles and said actuators, each of said flow distribution valves including a valve body which has one end positioned in an inlet passage connected to said meter-in variable throttle and the other end positioned in a control chamber, said valve body being moved through a stroke depending on balance between a pressure in said control chamber and a pressure in said inlet passage to control the pressure in said inlet passage, thereby controlling a differential pressure across said meter-in variable throttle, wherein said hydraulic circuit system further comprises a first hydraulic line provided in each of said plurality of control valves for, when a load pressure of the associated hydraulic actuator is the maximum load pressure, detecting that load pressure and introducing the detected load pressure to said control chamber;

a second hydraulic line provided in each of said plurality of control valves for connecting said control chamber to said signal detecting hydraulic line and introducing the signal pressure in said signal detecting hydraulic line to said control chamber when the load pressure of the associated hydraulic actuator is not the maximum load pressure;

a third hydraulic line for connecting said signal detecting hydraulic line to a reservoir;

a first throttle disposed in said third hydraulic line; and a second throttle disposed in said second hydraulic line of at least one of said plurality of control valves for, when the load pressure of the associated hydraulic actuator is the maximum load pressure, cooperating with said first throttle to modulate that load pressure and introducing the modulated load pressure, as the signal pressure, to said signal detecting hydraulic line.

2. A hydraulic circuit system according to claim 1, wherein said plurality of control valves further comprise respectively hold check valves disposed between said flow distribution valves and said hydraulic actuators whereby said first hydraulic lines detect, as the load pressures, pressures between said meter-in variable throttles and said hold check valves.

3. A hydraulic circuit system according to claim 1, wherein said flow distribution valve includes a hydraulic line slit formed in an outer periphery of the valve body thereof and opened to an outlet passage of said flow distribution valve, and a lap portion provided between said hydraulic line slit and said control chamber for making said hydraulic line slit open to said control chamber when the valve body of said flow distribution valve is moved through a stroke of predetermined distance in the valve opening direction, said hydraulic line slit and said lap portion jointly forming said first hydraulic line.

4. A hydraulic circuit system according to claim 1, wherein the valve body of each flow distribution valve of said plurality of control valves has a pressure bearing area on the side of the inlet passage larger than a pressure bearing area on the side of the control chamber.

5. A hydraulic circuit system according to claim 1, wherein said second throttle is a variable throttle , and means for adjusting an opening area of said variable throttle is provided.

6. A hydraulic circuit system comprising a hydraulic pump , a plurality of hydraulic actuators driven by a hydraulic fluid delivered from said hydraulic pump, a plurality of control valves disposed between said hydraulic pump and said plurality of actuators, a signal detecting hydraulic line to which a signal pressure based on a maximum load pressure among said plurality of hydraulic actuators is introduced, and pump control means for controlling a delivery pressure of said hydraulic pump to be held higher than said signal pressure by a predetermined value, said plurality of control valves comprising respectively main valves including meter-in variable throttles for controlling flow rates of the hydraulic fluid supplied to said hydraulic actuators , and pressure compensation valves disposed between said hydraulic pump and said meter-in variable throttles for controlling differential pressures across said meter-in variable throttles, wherein said hydraulic circuit system further comprises first hydraulic lines provided respectively in said plurality of control valves for introducing load pressures of the associated hydraulic actuators to pressure bearing sectors of said pressure compensation valves and controlling the differential pressures across said meter-in variable throttles;

second hydraulic lines provided respectively in said plurality of control valves for detecting the load pressures of the associated hydraulic actuator;

selecting means for detecting a maximum one of pressures in said second hydraulic lines of said plurality of control valves and introducing the detected maximum pressure, as the signal pressure, to said signal detecting hydraulic line;

a third hydraulic line for connecting said signal detecting hydraulic line to a reservoir;

a first throttle disposed in said third hydraulic line; and a second throttle disposed in said second hydraulic line of at least one of said plurality of control valves for, when the load pressure of the associated hydraulic actuator is the maximum load pressure, cooperating with said first throttle to modulate that load pressure and introducing the modulated load pressure, as the signal pressure, to said signal detecting hydraulic line.

* * * * *